United States Patent [19]

Ohtani et al.

[11] Patent Number: 4,868,086

[45] Date of Patent: Sep. 19, 1989

[54] ELECTROGRAPHIC TONER AND PROCESS FOR PREPARATION THEREOF

[75] Inventors: Shoji Ohtani, Osaka; Yukiya Sato, Wakayama; Kazunari Takemura, Wakayama; Rikio Tsushima, Wakayama, all of Japan

[73] Assignee: Kao Corporation, Tokyo, Japan

[21] Appl. No.: 266,331

[22] Filed: Nov. 1, 1988

Related U.S. Application Data

[63] Continuation of Ser. No. 35,357, Apr. 7, 1987, abandoned.

[30] Foreign Application Priority Data

Apr. 7, 1986 [JP] Japan ..... 61-79580

[51] Int. Cl.[4] ..... G03G 9/08

[52] U.S. Cl. ..... 430/137; 430/110

[58] Field of Search ..... 430/137, 110, 109, 107

[56] References Cited

U.S. PATENT DOCUMENTS

| | | | |
|---|---|---|---|
| 3,502,582 | 3/1970 | Clemens et al. | 252/62.1 |
| 3,830,850 | 8/1974 | Stratton | 568/609 |
| 4,146,494 | 3/1979 | Hectors et al. | 430/107 |
| 4,401,742 | 8/1983 | Chiang | 430/137 |
| 4,476,212 | 10/1984 | Kakimi | 430/137 |
| 4,689,181 | 8/1987 | Blatch | 428/447 |

FOREIGN PATENT DOCUMENTS

| | | |
|---|---|---|
| 0091086 | 3/1983 | European Pat. Off. . |
| 59-226357 | 12/1984 | Japan . |

OTHER PUBLICATIONS

Research Disclosures—Product Licensing Index, No. 100, Aug. 1972, pp. 54–56, Abstract No. 10020.

*Primary Examiner*—John L. Goodrow

*Attorney, Agent, or Firm*—Birch, Stewart, Kolasch & Birch

[57] ABSTRACT

A toner composition is obtained by the dispersion polymerization of a monomer in the presence of a charge-controlling agent, a colorant and a specified dispersant of a higher fatty acid salt of a long-chain alkyl or hydroxyalkyl amine, a polyoxyalkene-phenyl or alkylphenyl-ether or a polyethyleneimine. The toner composition is useful for developing an electrostatic image in an electrophotographic process and the like.

11 Claims, No Drawings

ELECTROGRAPHIC TONER AND PROCESS FOR PREPARATION THEREOF

This application is a continuation of application Ser. No. 035,357, filed on Apr. 7, 1987, now abandoned.

The present invention relates to a process for the preparation of a dry toner for developing an electrostatically charged image in an electrophotographic process, an electrostatic recording process and an electrostatic printing process and the like.

As developing methods using a dry toner composed mainly of a colorant and a resin, there can be mentioned (i) a two-component developer method in which a dry toner is mixed with a carrier having a particle size larger than that of the toner, a charge having a polarity reverse to the polarity of an electrostatically charged latent image is given to the toner by frictional charging and a developer composed of the above mixture of the toner and the carrier is brought into contact with the electrostatically charged latent image, and (ii) a one-component developer method in which a toner containing a magnetic material is contacted with or brought close to an electrostatically charged latent image.

For obtaining these toners, there has been adopted a process in which a thermoplastic resin is molten, a colorant such as a dye or pigment and, if necessary, a magnetic material, a frictional charge controlling agent, an offset-preventing agent, a lubricant and the like are added to the melt, the resulting composition is sufficiently blended and then cooled and solidified, and the solidified product is pulverized and classified to obtain a desired particle size.

This process, however, has various defects. In the first place, various apparatuses such as a polymerization apparatus for the production of the resin, a kneading apparatus, a pulverizer and a classifying apparatus are necessary, and the number of steps is large and the consumption of energy is large. Accordingly, the manufacturing cost is increased. In the second place, a homogeneous mixture can hardly be obtained in the kneading step, and especially, delicate conditions are necessary for uniform dispersion. In the third place, it is impossible to obtain only particles having a particle size appropriate for obtaining a clear image free of fog by the pulverizing operation and too fine particles and too coarse particles are simultaneously formed as by-products. Accordingly, the pulverizing step becomes complicated because these too fine and too coarse particles have to be removed and the yield of particles having a desirable particle size is low, resulting in an increase in the cost. In the fourth place, the formed powder has an indeterminate shape because it has been passed through the pulverizing step, and because of the poor flowability of the powder and the presence of a fine powder formed by stirring conducted at frictional charging, fogging is caused in the formed image.

As means for eliminating these defects, Japanese Patent Publications No. 10231/1961, No. 518305/1972 and No. 14895/1976 propose processes for preparing toners by suspension polymerization. It may be said that the foregoing defects can be eliminated according to the suspension polymerization process because pulverization is not necessary and the preparation is simplified. However, the suspension polymerization involves the following inherent problem.

The dry toner is composed mainly of a thermoplastic resin, and materials for imparting and improving various functions are incorporated in and mixed with the thermoplastic resin. For example, there are incorporated a colorant such as a dye or pigment, a charge controlling agent for improving the frictional chargeability, a magnetic material for imparting an adherence to a developing roller, an offset-preventing agent for preventing adherence of the toner to a fixing roller and an agent for improving the flowability of the toner. If these materials are uniformly dissolved in a polymerizable monomer and do not inhibit the polymerization reaction, no problem arises. However, most of these additives are insoluble or hardly soluble in the polymerizable monomer and have poor compatibility with the polymerizable monomer. Accordingly, it is difficult to uniformly incorporate these materials into polymer particles.

If these additives are heterogeneously present in the toner, the toner can not be sufficiently charged and the functions of the toner would be insufficiently exerted.

The charge controlling agent customarily added to the toner resin for controlling the frictional chargeability of the toner is ordinarily a compound having a carboxyl, amino, nitro, halogen, phenolic hydroxyl or sulfonic group or an azoic metal complex dye, all of which have a high polarity. Accordingly, the charge controlling agent is hardly soluble in a styrenic monomer, a methacrylate monomer or an acrylate monomer used for the toner, and even if the charge controlling agent is dispersed in the monomer by using dispersing means such as a ball mill, agglomeration still occurs during polymerization, or even if the polymerization can be carried out without agglomeration occurring, the charge controlling agent tends to be localized on the surfaces of the toner particles because of its high polarity or even migrates into the aqueous phase. This tendency is especially prominent in the case of an azoic metal complex dye which is very valuable as the charge controlling agent.

When the charge controlling agent cannot be uniformly dispersed as described above, sufficient chargeability cannot be imparted to the toner and the charge quantity is not uniform among toner particles, The result of this is that the charge quantity distribution is broadened and reversely charged particles are formed. Accordingly, adverse influences such as background fogging appear in the formed image and good image quality cannot be obtained.

Furthermore, since the charge controlling agent gathers on the surfaces of toner particles, they tend to separate from the toner particle surface because of rubbing contact between the particle during the printing operation, and the separated charge controlling agent adheres to the surface of the carrier to form a socalled spent toner. Accordingly, efficient frictional charging is inhibited, and the image quality is further degraded.

Moreover, if the charge controlling agent is predominantly present on the surfaces of toner particles, a leak of the charges readily occurs and the environment characteristics become degraded. Thus, if the charge controlling agent in the monomer is dispersed, various troubles arise. Accordingly, in order to improve the performance of the toner, it is important that the charge controlling agent be dispersed finely and uniformly in the monomer.

SUMMARY OF THE INVENTION

It is therefore a primary object of the present invention to provide a process for the preparation of a toner, in which the above-mentioned defects are overcome.

More specifically, the present invention relates to a process for the preparation of a toner in which a charge controlling agent is sufficiently dispersed and which provides an image excellent in quality. In short, the present invention is to provide a process for the preparation of a toner, in which the defects of the suspension polymerization process are overcome.

The toner composition according to the present invention is useful in an electrophotography process and comprises a polymer binder, a charge-controlling agent, a colorant and a dispersant selected from the group consisting of:

(1) a higher fatty acid salt of a long alkylamine or a long hydroxyalkylamine having the formula (I):

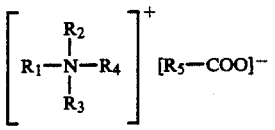

(I)

po0 in which R1, R2, R3 and R4 are each a long-chain alkyl or an alkenyl having 8 to 20 carbon atoms, a long-chain hydroxyalkyl or hydroxyalkenyl having 8 to 20 carbon atoms, a lower alkyl having 1 or 2 carbon atoms, a lower hydroxyalkyl having 1 to 2 carbon atoms and benzyl, with the proviso that one or two of R1, R2, R3 and R4 is said long-chain alkyl, a long-chain alkenyl, long-chain hydroxyalkyl or long-chain hydroxyalkenyl, and R5 is an alkyl or an alkenyl having 8 to 18 carbon atoms;

(2) a polyoxyalkylenephenylether or a polyoxyalkylene-alkylphenylether having the formula (V):

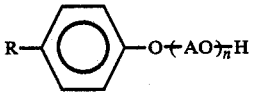

(V)

in which R is hydrogen or an alkyl having 1 to 18 carbon atoms, A is an alkylene having 2 to 4 carbon atoms and n is an integer of 1 to 100;

(3) a polyethyleneimine; and (4) a polyoxyalkylenephenylether derivative or a polyoxyalkylene-alkylphenylether derivative having the formulae (VI) or (VII):

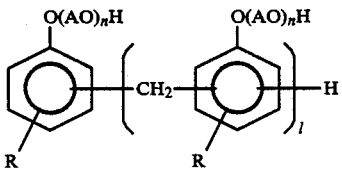

(VI)

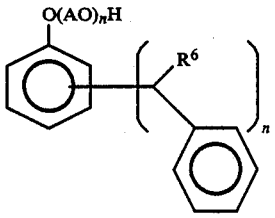

(VII)

in which R is hydrogen or an alkyl having 1 to 18 carbon atoms, R6 is hydrogen or methyl, A is an alkylene having 2 to 4 carbon atoms, 1 is an integer of 1 to 20, m is an integer of 1 to 5 and n is an integer of 1 to 100.

It is preferable that the dispersant is (1) the higher fatty acid salt of a long-chain alkylamine or a long-chain hydroxyalkylamine. It is preferable as well as practical that the toner comprises 100 parts by weight of the polymer, from 0.1 to 5 parts by weight of the charge-controlling agent, from 1 to 10 parts by weight of the colorant and from 0.005 to 15 parts by weight of the dispersant.

The present invention further provides a process for preparing a toner composition, which comprises the step of dispersion-polymerizing a monomer in the presence of a charge-controlling agent, a colorant and a dispersant as defined above. The presence of dispersant (1) is especially preferred in the process.

The present invention will be explained in detail first in respect to an embodiment using the dispersant (1).

The present inventors having conducted a research with a view toward attaining the above-mentioned object have found that if a charge controlling agent is dispersed in a monomer in the presence of a higher fatty acid salt of a long-chain alkylamine or a long-chain hydroxyalkylamine, the dispersibility of the charge controlling agent is highly improved. The present inventors have now completed the present invention based on this finding.

More specifically, in accordance with the present invention, there is provided a process for the preparation of a toner for developing an electrostatically charged image, which comprises dispersing a charge-controlling agent and a colorant in a polymerizable monomer in the presence of a higher fatty acid salt of a long-chain alkylamine or a long-chain hydroxyalkylamine represented by the following general formula

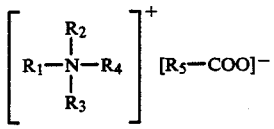

(I)

wherein $R_1$, $R_2$, $R_3$ and $R_4$ are each a long-chain alkyl or alkenyl group having 8 to 20 carbon atoms, a long-chain hydroxyalkyl or hydroxyalkenyl group having 8 to 20 carbon atoms, a lower alkyl group having 1 to 2 carbon atoms, a hydroxyalkyl group having 1 to 2 carbon atoms or a benzyl group, with the proviso that one or two of $R_1$, $R_2$, $R_3$ and $R_4$ is said long-chain alkyl or alkenyl group or said long-chain hydroxyalkyl or hydroxyalkenyl group, and $R_5$ stands for an alkyl or alkenyl group having 8 to 18 carbon atoms, and subjecting the dispersion to suspension polymerization.

According to the process of the present invention, the charge controlling agent can be easily dispersed in the monomer both finely and uniformly, and even during the suspension polymerization, the dispersion state is very stable and reagglomeration or localization of the charge controlling agent on the toner surface is prevented. Accordingly, the obtained toner is excellent in image quality and printing resistance.

As specific examples of the alkyl, hydroxyalkyl and alkenyl groups having 8 to 20 carbon atoms in the general formula (I) there can be mentioned alkyl groups such as $C_{10}H_{21}$—, $C_{12}H_{25}$—, $C_{14}H_{29}$—, $C_{16}H_{33}$— and $C_{18}H_{37}$—, alkenyl groups such as $C_{16}H_{31}$— and $C_{18}H_{35}$— and hydroxyalkyl groups such as $C_{10}H_{21}-\underset{\underset{OH}{|}}{CH}-CH_2-$, $C_{12}H_{25}-\underset{\underset{OH}{|}}{CH}-CH_2-$ and $C_{14}H_{29}-\underset{\underset{OH}{|}}{CH}-CH_2-$.

A mixture of these groups may also be used.

The higher fatty acid salt of the long-chain alkyl(alkenyl)amine or the long-chain hydroxyalkyl(alkenyl)amine represented by the general formula (I) is obtained in the form of a precipitate by dissolving a quaternary ammonium salt represented by the following formula (II):

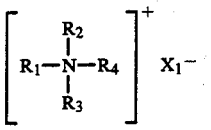

(II)

wherein $R_1$, $R_2$, $R_3$ and $R_4$ are as defined above and $X_1$ is a halogen atom, in water or a water-containing lower alcohol, adding a higher fatty acid salt represented by the following formula (III):

$$R_5-COOX_2 \quad \text{(III)}$$

wherein $X_2$ is a hydrogen atom or an alkali metal atom and $R_5$ is as defined above, to the solution and stirring the mixture under heating. The precipitate is recovered, washed with water and dried to obtain a quaternary ammonium fatty acid salt of a long-chain alkylamine or a long-chain hydroxyalkylamine.

As preferred examples of the higher fatty acid or its salt represented by the general formula (III) there can be mentioned $C_{11}H_{23}COOH$, $C_9H_{19}COONa$, $C_{15}H_{31}COOK$, $C_{15}H_{31}COOH$, $C_{13}H_{27}COONa$, $C_{17}H_{35}COOH$ and $C_{17}H_{35}COONa$.

As examples of the higher fatty acid salt of the long-chain alkylamine or the long-chain hydroxyalkylamine represented by the general formula (I) the following compounds can be mentioned:

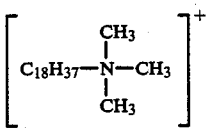

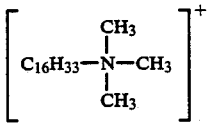

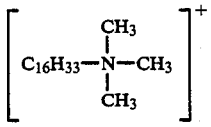

-continued

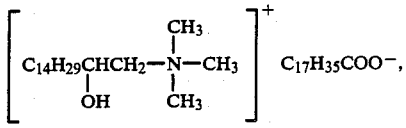

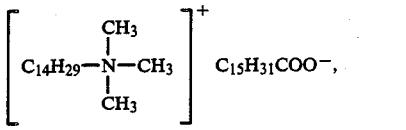

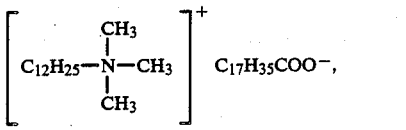

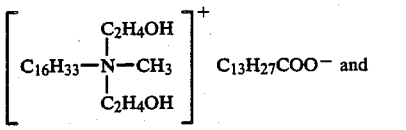

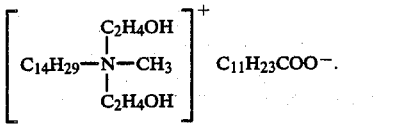

The charge controlling agent is incorporated into the monomer, to which is added the above-mentioned quaternary ammonium fatty acid salt. By stirring the resulting mixture, the charge controlling agent can be easily dispersed in the monomer.

As the charge controlling agent used in the present invention, for which an especially high dispersing effect is attained, there can be mentioned azoic metal complex dyes represented by the following general formula (IV):

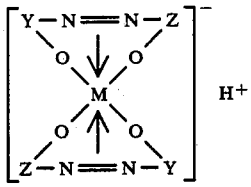

(IV)

In the above general formula, M represents a chromium or cobalt atom and Y and Z are each independently an aromatic ring-containing unit selected from the group consisting of:

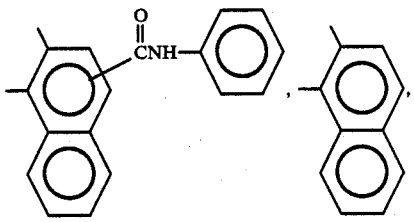

-continued

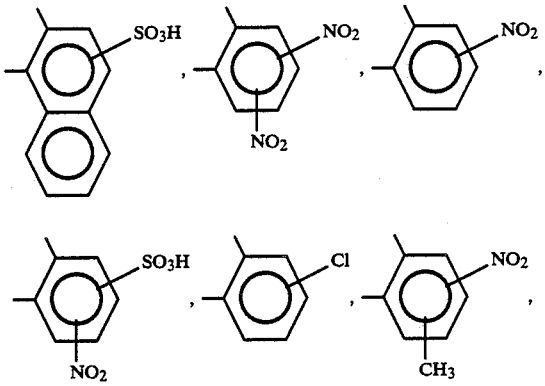

-continued

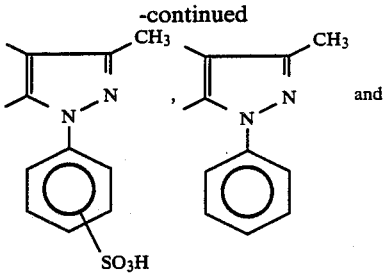

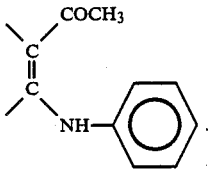

As specific examples, the following compounds can be mentioned:

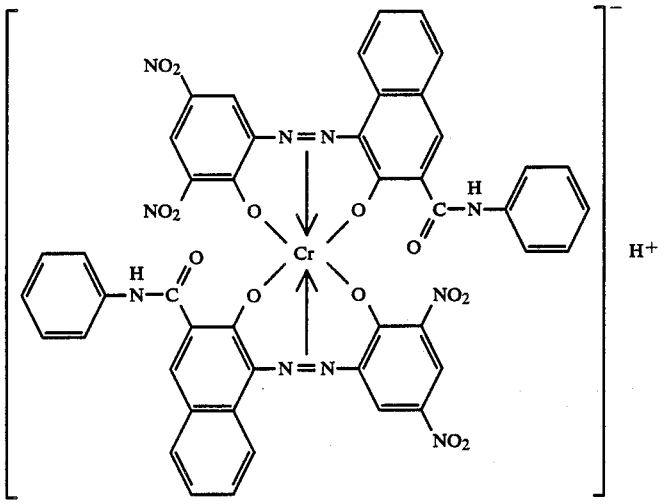

Aizenspiron Black TRH
(a product of Hodogaya Kagaku)

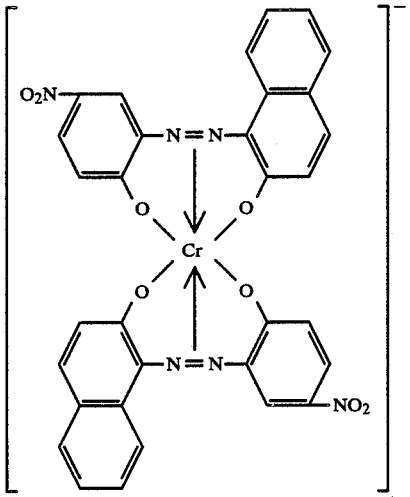

Aizenspiron Black BH
(a product of Hodogaya Kagaku)

The amount of the higher fatty acid salt of the long-chain alkylamine or the long-chain hydroxyalkylamine represented by the general formula (I) which is used in the present invention, is ordinarily 5 to 300% by weight, preferably 20 to 200% by weight, especially 50 to 150% by weight, based on the charge controlling agent.

In the present invention, the charge controlling agent represented by the general formula (IV) is used in an amount of up to 5% by weight, preferably 0.5 to 3% by weight, based on the polymerizable monomer.

According to the present invention, the charge controlling agent represented by the general formula (IV) the polymerization initiator and carbon black as the colorant are incorporated in the monomer and the quaternary ammonium fatty acid salt represented by the general formula (I) is added thereto. The resulting composition is mixed and dispersed to form an oil phase and the suspension polymerization is carried out to prepare polymer particles.

A known process can be used in the suspension polymerization. The dispersion of the oil phase is added to an aqueous phase of a homogeneous solution or dispersion of a suspension stabilizer such as a water-soluble polymer or hardly water-soluble inorganic salt, and oil drops having a size of 5 to 30 μm are dispersed by dispersing means such as a homogenizing mixer or a homogenizer. The weight ratio of the oil phase to the aqueous phase is from ½ to 1/10, which is selected so that coalescence of polymer particles does not occur. The homogeneous dispersion of the oil phase in the aqueous phase is transferred to a separable flask equipped with a stirrer, a condenser, a thermometer and a nitrogen-introducing tube, and the temperature is elevated to a level causing decomposition of the polymerization initiator (50° to 90° C.) to carry out the polymerization in a nitrogen atmosphere.

After completion of the polymerization, the reaction mixture is filtered to remove an aqueous phase. Inorganic powders, which inevitably adhering to the surfaces of toner particles, are removed by treatment with a diluted acid and the treated particles are washed with water and freed from the water by spray drying, vacuum drying or the like means, thus affording a toner.

Any polymerizable monomers can be used as the polymerizable monomer in the present invention. For example, there can be used styrene, p-chlorostyrene, p-methylstyrene, vinyl acetate, vinyl propionate, vinyl benzoate, methyl acrylate, ethyl acrylate, n-butyl acrylate, isobutyl acrylate, dodecyl acrylate, n-octyl acrylate, 2-ethylhexyl acrylate, methyl methacrylate, ethyl methacrylate, n-butyl methacrylate. isobutyl methacrylate, diethylaminoethyl methacrylate, t-butylaminomethyl methacrylate, acrylonitrile, 2-vinylpyridine and 4-vinylpyridine. A mixture of two or more of these monomers can also be used.

In the present invention, if a polyfunctional monomer such as divinylbenzene, ethylene glycol dimethacrylate, trimethylolpropane triacrylate, glycidyl methacrylate or glycidyl acrylate is added as a cross-linking agent to the polymerizable monomer, a toner having a highly improved durability can be prepared. The amount of the polyfunctional monomer is 0.05 to 20% by weight, preferably 0.5 to 5% by weight, based on the polymerizable monomer.

As the polymerization initiator, there can be used an oil-soluble peroxide polymerization initiator or azoic polymerization initiator customarily used in this field. For example, there can be mentioned benzoyl peroxide, lauroyl peroxide, 2,2'-azobisisobutyrontitrile, 2,2'-azobis-(2,4-dimethylvaleronitrile), o-chlorobenzoyl peroxide and o-methoxybenzoyl peroxide. The polymerization initiator is used in an amount of 0.1 to 10% by weight, preferably 0.5 to 5% by weight, based on the polymerizable monomer.

As the suspension stabilizer used in the present invention, there can be mentioned water-soluble polymers such as gelatin, starch, hydroxyethylcellulose, carboxymethylcellulose, polyvinylphyrrolidone, polyvinyl alkyl ether and polyvinyl alcohol, and hardly water-soluble inorganic salts such as barium sulfate, calcium sulfate, barium carbonate, calcium carbonate, magnesium carbonate and calcium phosphate. The suspension stabilizer is used in an amount of 0.1 to 5% by weight, preferably 0.5 to 2% by weight, based on water.

The toner of the present invention may further contain a low-molecular-weight olefin polymer known as a so-called release agent for preventing the offset phenomenon and improving the flowability and fixability.

It is preferred that the low-molecular-weight olefin polymer be present together with the colorant during the polymerization of the monomer.

As the low-molecular-weight olefin polymer used for the toner of the present invention, there can be mentioned polyethylene, polypropylene, an ethylene/vinyl acetate copolymer, a chlorinated polyethylene wax, a polyamide, a polyester, a polyurethane, polyvinyl butyral, a butadiene rubber, a phenolic resin, an epoxy resin, a rosin-modified resin, a silicone oil and a silicone wax.

The amount of the low-molecular-weight olefin polymer used is 1 to 20 parts by weight, preferably 3 to 15 parts by weight, per 100 parts by weight of the resin component of the toner. If the amount of the low-molecular-weight olefin polymer is smaller than 1 part by weight, it sometimes happens that no sufficient offset-preventing effect cannot be obtained, and if the amount of the low-molecular-weight olefin polymer is larger than 20 part by weight, gelation often occurs during the polymerization.

In order to form an image by using the toner of the present invention according to, for example, the electrophotographic process, a selenium photosensitive material, a photosensitive material comprising an electroconductive support and, formed thereon, a photosensitive layer formed of a dispersion of an inorganic photoconductive material such as zinc oxide, cadmium sulfide, cadmium selenide, cadmium sulfoselenide, lead oxide or mercury sulfide in a binder resin, a photosensitive material comprising an electroconductive support and, former thereon, a photosensitive layer composed of an organic photoconductive material such as anthracene or polyvinylcarbazole, which is incorporated in a binder resin according to need, can be used. The surface of the photosensitive layer of the photosensitive material is entirely charged by means of corona discharge with a Corotron or Scorotron charger and the charged surface is exposed imagewise to light or the like to form an electrostatically charged image. According to the cascade method or magnetic brush method, the electrostatically charged image is developed with a developer comprising a mixture of the toner of the present invention and a glass bead or iron powder carrier to form a toner image. The toner image is transferred onto, for example, a transfer sheet by pressing the toner image to the transfer sheet under corona discharge. The toner image transferred onto the transfer sheet is heated and fixed with a hot roll fixer covered with a fluororesin or silicone rubber having a release property.

As is apparent from the foregoing detailed description, the toner for developing an electrostatically charged image, which is obtained according to the preparation process of the present invention, is in the form of spherical polymer particles formed by incorporating and dispersing a charge controlling agent in a monomer together with a colorant and a specific dispersion stabilizer and subjecting the dispersion to suspension polymerization. Accordingly, in the toner obtained according to the present invention, the dispersibility of the charge controlling agent is much higher than in the toner prepared according to conventional processes. Furthermore, occurrence of fogging during the reproduction operation can be prevented. Further, according to the present invention, there is provided a process for preparing a toner having such excellent properties and being further improved in the developability, transferability and printing resistance.

The present invention will be shown below in respect to the dispersant (2).

With the intention of attaining the above-mentioned objects, the present inventors have made earnest studies and, as a result of the studies, found that dispersibility of a charge controlling agent is remarkably improved when dispersion of the charge controlling agent in a polymerizable monomer is carried out in the presence of a polyoxyalkylene (alkyl)phenyl ether having a specified structure.

Thus, in a first aspect, the present invention provides a toner for developing an electrostatic image in an electrophotographic process, which comprises a binder polymer, a charge controlling agent, a colorant and a polyoxyalkylene (alkyl)phenyl ether represented by the following general formula (V):

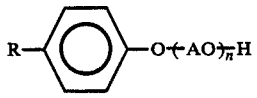

(V)

wherein R represents a hydrogen atom or an alkyl group having 1 to 18 carbon atoms, A represents an alkylene group having 2 to 4 carbon atoms and n represents an integer of 1 to 100. In a second aspect the present invention provides a process for preparation of a toner for developing an electrostatic image, which comprises dispersing a charge controlling agent and a colorant in a polymerizable monomer and subjecting the resultant dispersion to suspension polymerization, wherein the charge controlling agent is dispersed in the polymerizable monomer in the presence of a polyoxyalkylene (alkyl)phenyl ether represented by the above-mentioned general formula (V) prior to the suspension polymerization.

According to the process of the present invention, the charge controlling agent can be easily dispersed in the monomer finely and uniformly, and even during the suspension polymerization, the dispersion is so stable that the toner can be prepared without causing reaggregation or localization of the charge controlling agent on the toner surfaces. Accordingly, the toner thus obtained shows excellent image quality and durability in repeated printing.

The polyoxyalkylene (alkyl)phenyl ether represented by the above-mentioned general formula (V) for use n the present invention, can be obtained by addition polymerization of an alkylene oxide onto the active hydrogen of the phenolic hydroxyl group of phenol or an alkylphenol by using a catalyst such as alkali.

Examples of the polyoxyalkylene (alkyl)phenyl ether represented by the general formula (V) include the following:

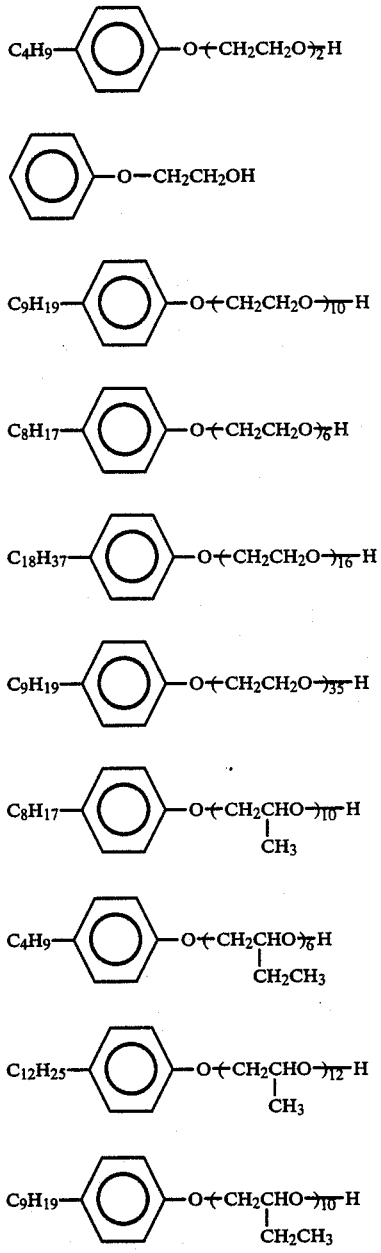

In the polyoxyalkylene (alkyl)phenyl ether represented by the above-mentioned general formula (V) for use in the present invention, the number of moles of the oxyalkylene group added is generally 1 to 100 moles, preferably 1 to 50 moles, and the alkylene group is preferably the ethylene group. The ether may be used in the composition in an amount of 5 to 200 wt.%, preferably 20 to 150 wt.%, based on the charge-controlling agent. A single species of the ether or a combination of two or more may be used.

As has been detailed above, the toner for developing an electrostatic image, wihch is obtained according to the present invention, is in the form of spherical polymer particles obtained by mixing and dispersing a charge controlling agent in a polymerizable monomer together with a specified dispersion stabilizer and subjecting the dispersion to suspension polymerization. Accordingly, in the toner obtained according to the present invention, the dispersibility of the charge controlling agent is superior to that in toners prepared by conventional processes. Furthermore, the toner obtained according to the present invention is improved in the property of fogging during the copying operation, and is further improved in developability, transferability and durability during repeated printing, as compared to conventional toners. Thus, the present invention provides a toner and a process for preparation thereof which are superior to conventional toners and preparation processes in view of the above-mentioned points.

The invention will be below explained in respect to the dispersant (3).

Thus, in a first aspect, the present invention provides a toner for developing an electrostatic image, which comprises a binder polymer, a charge controlling agent, a colorant and polyethyleneimine. In a second aspect the invention provides a process for preparation of a toner for developing an electrostatic image, which comprises dispersing a charge controlling agent and a colorant in a polymerizable monomer and subjecting the resultant dispersion to suspension polymerization, wherein the charge controlling agent is dispersed in the polymerizable monomer in the presence of polyethyleneimine, prior to the polymerization.

According to the process of the present invention, the charge controlling agent can be easily dispersed in the monomer finely and uniformly, and even during the suspension polymerization, the dispersion is so stable that the toner can be prepared without causing reagregation or localization of the charge controlling agent on the toner surfaces. Accordingly, the toner thus obtained shows excellent image quality and durability repeated printing.

The polyethyleneimine for use in the present invention is preferably a straight chain or branched polymer having a weight molecular weight of 200 to 20,000.

In the process according to the present invention, the charge controlling agent is placed in the polymerizable monomer, to which polyethyleneimine is added, and the resultant mixture is agitated, whereby the charge controlling agent can be easily dispersed in the monomer.

In the present invention, polyethyleneimine is ordinarily used in an amount of 5 to 200% by weight, preferably 30 to 150% by weight, based on the charge controlling agent. Two or more polyethyleneimines may be used in combination.

The invention will be below illustrated in respect to the dispersant (4).

With the intention of attaining the abovementioned objects, the present inventors have made earnest studies and, as a result of the studies, found that dispersibility of a charge controlling agent is remarkably improved when dispersion of the charge controlling agent in a polymerizable monomer is carried out in the presence of polyoxyalkylene (alkyl)phenyl ether derivative(s) having a specified structure. Based on the finding, the present invention has been attained.

Accordingly, in a first aspect, the present invention provides a toner for developing an electrostatic image, which comprises a binder polymer, a charge controlling agent, a colorant and polyoxyalkylene (alkyl)-phenyl ether derivative(s) represented by the following general formula(s) (VI) or (VII):

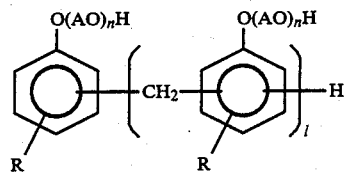

(VI)

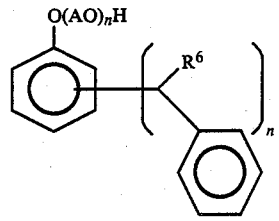

(VII)

wherein R represents H or an alkyl group having 1 to 18 carbon atoms, $R^6$ represents H or $CH_3$, A represents an alkylene group having 2 to 4 carbon atoms, l represents an integer of 1 to 20, m represents an integer of 1 to 5 and n represents an integer of 1 to 100. In a second aspect, the present invention provides a process for preparation of a toner for developing an electrostatic image, which comprises dispersing a charge controlling agent and a colorant in a polymerizable monomer and subjecting the resultant dispersion to suspension polymerization, wherein the charge controlling agent is dispersed in the polymerizable monomer in the presence of polyoxyalkylene (alkyl)phenyl ether derivative(s) represented by the above general formula(s) (VI) or (VII) prior to the polymerization.

According to the process of the present invention, the charge controlling agent can be easily dispersed in the monomer finely and uniformly, and even during the suspension polymerization, the dispersion is so stable that the toner can be prepared without causing reaggregation or localization of the charge controlling agent on the toner surfaces. Accordingly, the toner thus obtained shows excellent image quality and durability in repeated printing.

The polyoxyalkylene (alkyl)phenyl ether derivative represented by the general formula (VI), for use in the present invention, can be prepared by, for example, bringing phenol or an alkylphenol into dehydration condensation with formaldehyde in the presence of a hydrochloric acid catalyst, followed by addition of an alkylene oxide to the condensate.

The polyoxyalkylene (alkyl)phenyl ether derivative represented by the general formula (VII) can be prepared by, for example, modified phenol by styrene, followed by addition of an alkylene oxide.

Typical examples of the general formula (VI) include the following:

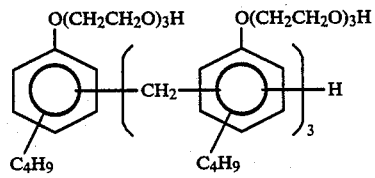

-continued

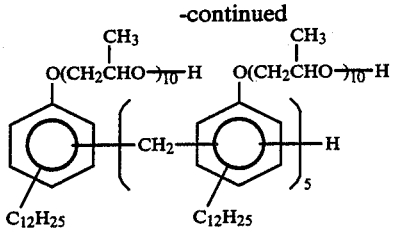

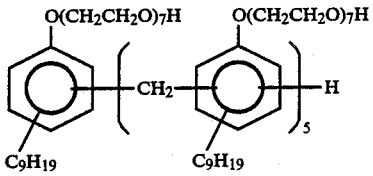

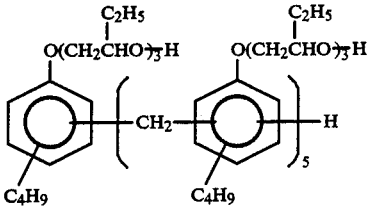

Specific examples of the of the general formula (VII) include the following general formula (VII'):

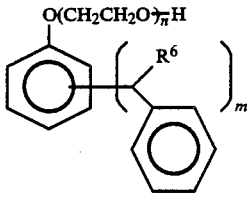

(VII')

and specific examples of the compounds of the general formula (VII') include Emulgen A-60, which has an average degree of styrene addition to phenol, $\bar{m}$, of 2.2, an average number of moles of ethylene oxide added, $\bar{n}$, of 12.8 and $R^6=CH_3$ in the general formula (VII'), Emulgen A-90, which has $\bar{m}=2.2$, $\bar{n}=18.3$ and $R^6=CH_3$, and Emulgen A-500, which has m =2.2, $\bar{n}=63.9$ and $R^6=CH_3$ (all of the Emulgens are products by Kao Corporation).

In the polyoxyalkylene (alkyl)phenyl ether derivative(s) represented by the general formula(s) (VI) and/or (VII) for use in the present invention, the number of moles of the oxyalkylene groups added is generally 1 to 100 moles, preferably 5 to 35 moles, and the alkylene is preferably ethylene. The derivative may be used in an amount of 5 to 200 wt.%, preferably 20 to 150 wt.%, based on the charge-controlling agent.

In the process according to the present invention, the charge controlling agent is placed in the polymerizable monomer, to which is added the polyoxyalkylene (alkyl)phenyl ether derivative(s) represented by the general formula(s) (VI) or (VII) and the resultant mixture is agitated, whereby the charge controlling agent can be easily dispersed in the monomer.

In the following examples, all of "parts" are by weight.

EXAMPLE 1

A mixture of 85 parts of styrene, 15 parts of n-butyl acrylate, 2 parts of Aizenspiron Black TRH, tradename, a product of Hodogaya Chemical Co., Ltd., and 1 part of a higher fatty acid salt of a long-chain alkylamine represented by the following formula:

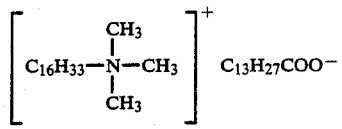

is stirred and dispersed. When the stirred mixture is observed with an optical microscope, it is found that the charge controlling agent in the monomer is very fine and an undesirable phenomenon such as agglomeration is not caused, and it is confirmed that the dispersibility is good. To this mixture are added 6 parts of carbon black #44 of Mitsubishi Chemical Industries, Ltd. and 2 parts of a low molecular weight polyethylene, Mitsui Hi-Wax 210P, tradename, of Mitsui petrochemical Industries, Ltd, and the resultant is dispersed for 10 hours with a ball mill. In the obtained dispersion is dissolved 1 part of 2,2'-azobisisobutyronitrile. Then, the dispersion is added to 250 parts of a 1% aqueous solution of polyvinyl alcohol (Gosenol GL-05, a product of Nippon Synthetic Industry Co., Ltd.) and the mixture is stirred at 6000 rpm for 3 minutes with a TK homogenizing mixture of Tokushu Kika Cogyo Co., Ltd. In a separable flask, polymerization is carried out at 75° C. for 8 hours in a nitrogen atmosphere at a stirring speed of 100 rpm by using an ordinary stirrer. After termination of the polymerization, centrifugal separation and water washing are repeated and the obtained polymer is dried under reduced pressure to obtain a spherical toner having an average particle size of 10 μm.

A developer is prepared by mixing 5 parts of the obtained toner with 95 parts of an iron powder carrier (CB-100, a product of D.M. Stewart). Copying is carried out by using this developer in a copying machine (Ricoh FT4030), and a black sharp image is obtained without suffering fogging. The printing resistance test is carried out by forming 50,000 prints. The image quality is not substantially changed and the image is as sharp as the initially obtained image.

COMPARATIVE EXAMPLE 1

A mixture comprising 85 parts of styrene, 15 parts of n-butyl acrylate and 2 parts of Aizenspiron Black TRH as the charge controlling agent is stirred and, when the stirred mixture is observed with an optical microscope, it is found that the charge controlling agent is present in the form of agglomerates of particles having a diameter of 2 to 3 μm and the charge controlling agent is not sufficiently dispersed. The mixture was dispersed for 10 hours with a ball mill and, when the mixture is observed with an optical microscope, it is found that the particle size of the charge controlling agent is reduced to about 1 μm but the particles are still agglomerated and not sufficiently dispersed in the monomer. To the dispersion were added 6 parts of carbon black (#44 supplied by Mitsubishi Kasei) and 2 part of low-molecular-weight polyethylene (Mitsui Hi-Wax 210P, a product of Mitsui Sekiyu Kagaku Kogyo), and a toner is prepared in the same manner as described in Example 1. After the suspension polymerization, the aqueous phase had a violet color and it is confirmed that a part of the charge controlling agent migrated into the aqueous phase.

A developer is prepared by mixing 5 parts of the obtained toner with 95 parts of an iron powder carrier (CB-10, tradename, of D.M. Stewart). Copying is carried out by using this developer on a Ricoh FT4030. The image is somewhat obscure and uneven and much fogging is observed. When the printing resistance test is carried out by forming 3000 prints, the image quality is further degraded and the image density was reduced. After the printing resistance test, the developer is separated into the toner and carrier and, when the carrier is washed with ethyl alcohol, the violet charge controlling agent is dissolved out and it is found that the charge controlling agent migrated to the carrier surface from the toner surface.

EXAMPLE 2

A toner is prepared in the same manner as described in Example 1 except that a higher fatty acid salt of a long-chain hydroxyalkylamine represented by the following formula:

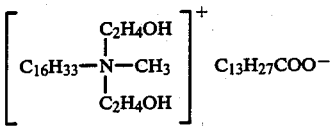

is used instead of the long-chain alkylamine higher fatty acid salt used in Example 1. By using this toner, copying is carried out in the same manner as described in Example 1. A sharp image having a sufficient image density and having no fog is obtained.

EXAMPLE 3

A mixture comprising 80 parts of styrene, 10 parts of n-butyl methacrylate, 10 parts of 2-ethylhexyl acrylate, 5 parts of carbon black (#30 supplied by Mitsubishi Kasei), 2 parts of Aizenspiron Black BH (a product of Hodogaya Kagaku), 0.5 part of a higher fatty acid salt of a long-chain alkylamine represented by the general formula:

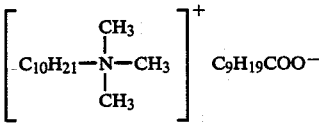

and 1.5 parts of low-molecular-weight polyethylene (Mitsui Hi-Wax, a product of Mitsui Sekiyu Kagaku) is dispersed for 10 hours with a ball-mill. In the dispersion is dissolved 2 parts of 2,2'-azobis-(2,4-dimethylvaleronitrile) and 200 parts of a 1.5% aqueous solution of polyvinyl alcohol (gosenol GM-14, a product of Nippon Gosei Okagaku Kogyo) is added to the dispersion. The mixture is stirred for 3 minutes at 7000 rpm with a TK homogenizing mixer (mfd. by Tokushu Kika Kogyo). A spherical toner having an average particle size of 10 μm is prepared in the same manner as described in Example 1. By using the toner, copying is carried out in the same manner as described in Example 1. A sharp image having a sufficient image density and having no fog is obtained.

EXAMPLE 4

A mixture of 85 parts of styrene, 15 parts of n-butyl acrylate, 2 parts of Aizenspiron Black TRH (a product by Hodogaya Chemical Co., Ltd.) as the charge controlling agent and 1 part of a polyoxyethylene nonylphenyl ether represented by the following formula:

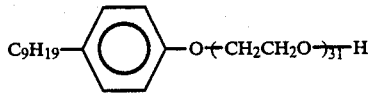

is dispersed by agitation.

The thus agitated mixture is observed under an optical microscope, to find that the charge controlling agent in the monomer is very fine and free of aggregation or the like phenomena, showing good dispersibility. To the mixture are added 6 parts of carbon black (#44, a product by Mitsubishi Chemical Industries, Ltd.) and 2 parts of a low molecular weight polyethylene (Mitsui Hi-Wax 210P, a product by Mitsui Petrochemical Industries, Ltd.), and the resultant mixture is dispersed for 10 hours in a ball mill.

In the thus obtained dispersion is dissolved 1 part of 2,2'-azobisisobutyronitrile. Then, the dispersion is added to 250 parts of a 1% aqueous solution of polyvinyl alcohol (Gosenol GL03, a product by The Nippon Synthetic Chemical Industry Co., Ltd.), and the mixture is agitated by a TK homomixer (mfd. by Tokushu Kika Kogyo Co., Ltd.) at 8000 rpm for 3 minutes. The thus obtained suspension is placed in a separable flask and subjected to polymerization at 75° C. for 8 hours in a nitrogen atmosphere with agitation by an ordinary agitator at an agitation speed of 100 rpm. After completion of the polymerization, centrifugal separation and washing with water are repeated, and the thus obtained polymer is dried under a reduced pressure to obtain a spherical toner having an average particle diameter of 11 μm.

A developer is prepared by mixing 5 parts of the toner obtained above with 95 parts of an iron powder carrier (CB-100, a product by D.M. Stewart). Copying is carried out using the developer in a copying machine (Ricoh FT4030), and a clear image free of fog is obtained. The durability in repeated printing is tested by forming up to 100,000 prints, upon which the image quality was not substantially changed and the image is as clear as the initially obtained image.

EXAMPLE 5

A toner is prepared under the same conditions as in Example 4 except that a polyoxyethylene butylphenyl ether represented by the following formula is used in place of the polyoxyethylene nonylphenyl ether used in Example 4.

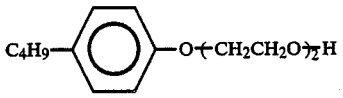

By using the thus obtained toner, copying is carried out in the same manner as in example 4, and a clear image with a sufficient density free of fog is obtained.

EXAMPLE 6

A toner is prepared under the same conditions as in Example 4 except that a polyoxyethylene stearylphenyl ether is used in place of the polyoxyethylene nonylphenyl ether used in Example 4.

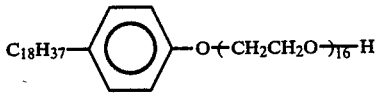

By using the thus obtained toner, copying is carried out in the same manner as in Example 4, and a clear image having a sufficient density and free of fog is obtained.

EXAMPLE 7

A mixture of 80 parts of styrene, 10 parts of n-butyl methacrylate, 10 parts of 2-ethylhexyl acrylate, 5 parts of carbon black (#30, a product by Mitsubishi Chemical Industries, Ltd.), 2 parts of Aizenspiron Black BH (a product by Hodogaya Chemical Co., Ltd.), 1.5 parts of a polyoxyethylene octylphenyl ether represented by the following formula:

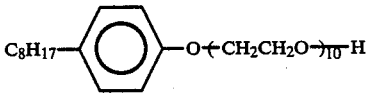

and 1.5 parts of a low molecular weight polyethylene (Mitsui Hi-Wax 4052E, a product by Mitsui Petrochemical Industries, Ltd.) is dispersed for 10 hours in a ball mill. In the thus obtained dispersion is dissolved 2 parts of 2,2'-azobis(2,4-dimethylvaleronitrile). Then, the dispersion is added to 200 parts of a 1.5% aqueous solution of polyvinyl alcohol (Gosenol GM-14, a product by The Nippon Synthetic Chemical Industry Co., Ltd.), and the resultant mixture is agitated by a TK homomixer (mfd. By Tokushu Kika Kogyo Co., Ltd.) at 7000 rpm for 3 minutes. By using the suspension thus obtained, a spherical toner having an average particle diameter of 10 μm is prepared in the same manner as in Example 4. The thus obtained toner is served to copying in the same manner as in Example 4, to give a clear image having a sufficient density and free of fog.

EXAMPLE 8

A toner is prepared in the same manner as in Example 7 except that oxyethylene phenyl ether was used in place of the polyoxyethylene octylphenyl ether used in Example 7.

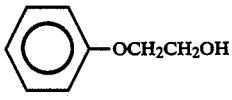

When the thus obtained toner is served to copying in the same manner as in Example 7, a clear image having a sufficient density and free of fog was obtained.

EXAMPLE 9

A mixture of 85 parts of styrene, 15 parts of n-butyl acrylate, 2 parts of Aizenspiron Black TRH (a product by Hodogaya Chemical Co., Ltd.) as the charge controlling agent and 2 parts of a polyethyleneimine having an average molecular weight of 1200 (SP-0120, a product by Nippon Shokubai Kagaku Kogyo Co., Ltd.) is dispersed by agitation.

When the thus agitated mixture is observed under an optical microscope, it is found that the charge controlling agent in the monomer is very fine and free of aggregation or the like phenomena, showing good dispersibility. To the mixture are added 6 parts of carbon black (#44, a product by Mitsubishi Chemical Industries, Ltd.) and 2 parts of a low molecular weight polyethylene (Mitsui Hi-Wax 210P, a product by Mitsui Petrochemical Industries, Ltd.), and the resultant mixture is dispersed for 10 hours in a ball mill.

In the thus obtained dispersion is dissolved 1 part of 2,2'-azobis-isobutyrontitrile. Then the dispersion is added to 250 parts of a 1% aqueous solution of polyvinyl alcohol (Cosenol GL-03, a product by The Nippon Synthetic Chemical Industry Co., Ltd.), and the mixture is agitated by a TK homomixer (mfd. by Tokushu Kika Kogyo Co., Ltd.) at 8000 rpm for 3 minutes. The thus obtained suspension is placed in a separable flask and subjected to polymerization at 75° C. for 8 hours in a nitrogen atmosphere with agitation by an ordinary agitator at an agitation speed of 100 rpm. After completion of the polymerization, centrifugal separation and washing with water are repeated, and the thus obtained polymer is dried under a reduced pressure to obtain a spherical toner having an average particle diameter of 11 μm.

A developer is prepared by mixing 5 parts of the toner obtained above with 95 parts of an iron powder carrier (CB-100, a product by D.M. Stewart). Copying is carried out using the developer in a copying machine (Ricoh FT4030), and a clear image free of fog is obtained. The durability in repeated printing is tested by forming up to 100,000 prints, upon which the image quality is not substantially changed and the image is as clear as the initially obtained image.

EXAMPLE 10

A mixture of 80 parts of styrene, 10 parts of n-butyl methacrylate, 10 parts of 2-ethylhexyl acrylate, 5 parts of carbon black (#30, a product by Mitsubish Chemical Industries, Ltd.), 2 parts of Aizenspiron Black BH (a product by Hodogaya Chemical Co., Ltd.), 1.5 parts of polyethyleneimine having an average molecular weight of 10,000 (SP-2000, a product of Nippon Shokubai Kagaku Kogyo Co., Ltd.) and 1.5 parts of a low molecular weight polyethylene, Mitsui Hi-Wax 4052E, tradename, of Mitsui Pertrochemical Industries, Ltd.) is dispersed for 10 hours in a ball mill. In the resultant dispersion is dissolved 2 parts of 2,2'-azobis(2,4-dimethylvaleronitrile). Then, the dispersion is added to 200 parts of a 1.5% aqueous solution of polyvinyl alcohol (Gosenol GM-14, a product by The Nippon Synthetic Chemical Industry Co., Ltd.), and the resultant mixture is agitated by a TK homomixer (mfd. by Tokushu Kika Kogyo Co., Ltd.) at 7000 rpm for 3 minutes. by using the suspension thus obtained, a spherical toner having an average particle diameter of 10 μm is prepared in the same manner as in example 9. When the thus obtained toner is served to copying in the same manner as in Example 9, a clear image having a sufficient density and free of fog is obtained.

EXAMPLE 11

A mixture of 85 parts of styrene, 15 parts of n-butyl acrylate, 2 parts of Aizenspiron Black TRH (a product of Hodogaya Chemical Co., Ltd.) as the charge controlling agent and 1 part of a polyoxyethylene alkylphenyl ether derivative having the formula (VIII) is dispersed by agitation.

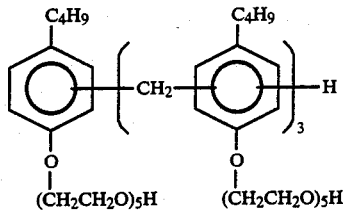

(VIII)

The thus agitated mixture is observed under an optical microscope, to find that the charge controlling agent in the monomer is very fine and free of aggregation or the like phenomena, showing good dispersibility. To the mixture are added 6 parts of carbon black (#44, a product by Mitsubishi Chemical Industries, Ltd.) and 2 parts of a lower molecular weight polyethylene (Mitsui Hi-Wax 210P, a product by Mitsui Petrochemical Industried, Ltd.), and the resultant mixture is dispersed for 10 hours in a ball mill.

In the thus obtained dispersion is dissolved 1 part of 2,2'-azobisisobutyronitrile. Then, the dispersion is added to 250 parts of a 1% aqueous solution of polyvinyl alcohol (Gosenol GL-05, a product by The Nippon Synthetic Chemical Industry Co., Ltd.), and the mixture is agitated by a TK homomixer (mfd. by Tokushu Kika Kogyo Co., Ltd.) at 6000 rpm for 3 minutes. The thus obtained suspension is placed in a separable flask and subjected to polymerization at 75° C. for 8 hours in a nitrogen atmosphere with agitation by an ordinary agitator at an agitation speed of 100 rpm. After completion of the polymerization, centrifugal separation and washing with water are repeated, and the thus obtained polymer is dried under a reduced pressure to obtain a spherical toner having an average particle diameter of 10 μm.

A developer is prepared by mixing 5 parts of the toner obtained above with 95 parts of an iron powder carrier (CB-100, a product by D.M. Stewart). Copying is carried out using the developer in a copying machine (Ricoh FT4030), and a clear image free of fog is obtained. The durability in repeated printing is tested by forming up to 50,000 prints, upon which the image quality is not substantially changed and the image is as clear as the initially obtained image.

EXAMPLE 12

A toner is prepared in the same manner as in example 11 except for using Emulgen A-60 in place of the compound (VIII).

By using the thus obtained toner, reproduction is carried out in the same manner as in Example 1, and a clear image having a sufficient density and free of fog is obtained.

EXAMPLE 13

A toner is prepared in the same manner as in Example 11 except that a polyoxyethylene phenyl ether having the formula (IX) is used in place of the compound (VIII) used in Example 11.

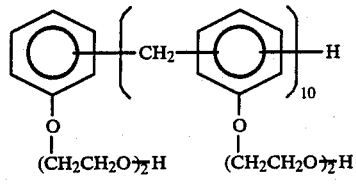

(IX)

By using the thus obtained toner, reproduction is carried out in the same manner as in Example 11, and a clear image having a sufficient density and free of fog is obtained.

EXAMPLE 14

A toner is prepared in the same manner as in Example 11 except that a polyoxyethylene alkylphenyl ether of the formula (VI), in which R is $C_9H_{19}$, AO is $CH_2CH_2O$, l=3 and n=10 (hereinafter referred to as "compound (X)") was used in place of the compound (VIII) used in Example 11.

The thus obtained toner is served to copying in the same manner as in Example 11, to give a clear image having a sufficient density and free of fog.

EXAMPLE 15

A mixture of 80 parts of styrene, 10 parts of n-butyl methacrylate, 10 parts of 2-ethylhexyl acrylate, 5 parts of carbon black (#30, a product of Mitsubishi Chemical Industries, Ltd.), 2 parts of Aizenspiron Black BH (a product of Hodogaya Chemical Co, Ltd.), 1.5 parts of a polyoxyethylene alkylphenyl ether derivative of the the formula (VI), in which R is $C_{12}H_{25}$, A0 is $CH_2CH_2O$, l=5 and n=16 (hereinafter referred to as "compound (XI)") and 1.5 parts of a low molecular weight polyethylene (Mitsui Hi-Wax 4052E, a product by Mitsui Petrochemical Industries, Ltd.) is dispersed for 10 hours in a ball mill. In the thus obtained dispersion is dissolved 2 parts of 2,2-azobis(2,4-dimethylvaleronitrile). Then, the dispersion is added to a 1.5% aqueous solution of polyvinyl alcohol (Gosenol GM-14, a product by The Nippon Synthetic Chemical Industry Co., Ltd.), and the resultant mixture is agitated by a TK homomixer (mfd. by Tokushu Kika Kogyo Co., Ltd.) at 7000 rpm for 3 minutes. By using the suspension thus obtained, a spherical toner having an average particle diameter of 10 μm is prepared in the same manner as in Example 11. The thus obtained toner is served to copying in the same manner as in Example 11, to give a clear image having a sufficient density and free of fog.

What is claimed is:

1. A process for preparing a toner composition comprising a polymer binder, a colorant, a charge-controlling agent and a dispersant which is useful for developing an electrostatically charged image in an electrophotographic method comprising:

forming a composition comprising a monomer, a colorant, 0.1 to 10% by weight of a polymerization initiator based on the monomer, 0.5 to 5 percent by weight of a charge-controlling agent based on the toner and 5 to 300 percent by weight of a dispersant based on the charge-controlling agent, wherein said dispersant is selected from the group consisting of:

(1) a higher fatty acid salt of a long-chain alkylamine or a long-chain hydroxyalkylamine having the formula (I):

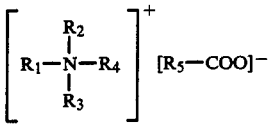

(I)

in which R1, R2, R3 and R4 are each a long-chain alkyl or alkenyl having 8 to 20 carbon atoms, a long-chain hydroxyalkyl or hydroxyalkenyl having 8 to 20 carbon atoms, a lower alkyl having 1 to 2 carbon atoms, a lower hydroxyalkyl having 1 to 2 carbon atoms or benzyl, with a proviso that one or two of R1, R2, R3 and R4 is the long-chain alkyl, the long-chain alkenyl, the long-chain hydroxyalkyl or the long-chain hydroxyalkenyl, and R5 is an alkyl or an alkenyl having 8 to 18 carbon atoms;

(2) a polyoxyalkylenephenylether or a polyoxyalkylenealkylphenylether having the formula (V):

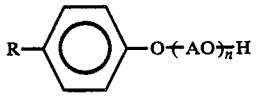

(V)

in which R is hydrogen or an alkyl having 1 to 18 carbon atoms, A is an alkylene having 2 to 4 carbon atoms and n is an integer of 1 to 100;

(3) a polyethylenemine and (4) a polyoxyalkylenephenylether derivative(s) or a polyoxyalkylene-alkylphenylether derivative(s) having the formulae (VI) or (VII), respectively:

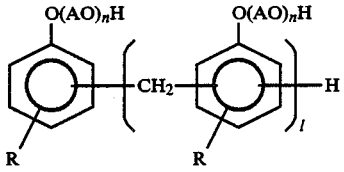

(VI)

-continued

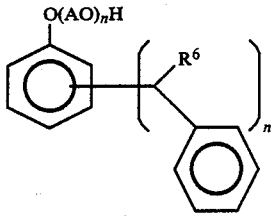

(VII)

in which R is a hydrogen or an alkyl having 1 to 18 carbon atoms, R6 is hydrogen or methyl, A is an alkylene having 2 to 4 carbon atoms, l is an integer of 1 to 20, m is an integer of 1 to 5 and n is an integer of 1 to 100, stirring said composition to mix and disperse the colorant, polymerization initiator and charge-controlling agent in the monomer to form an oil phase, adding and dispersing the oil phase in an aqueous phase to form a polymerizable suspension composition, and heating and dispersion-polymerizing the polymerizable suspension composition to form the toner composition.

2. The process of claim 1, in which the dispersant is (1).

3. The process of claim 1, in which the dispersant is (2).

4. The process of claim 1, in which the dispersant is (3).

5. The process of claim 1, in which the dispersant is (4).

6. The process of claim 5, in which the dispersant is the polyoxyalkylenephenylether derivative(s).

7. The process of claim 5, in which the dispersant is the polyoxyalkylene-alkylphenylether derivative(s).

8. The process of claim 1, in which the dispersant is present in an amount of 20 to 200 percent by weight.

9. The process of claim 1, in which the dispersant is present in an amount of 50 to 150 percent.

10. The process of claim 1, wherein the dispersion-polymerizating of the polymerizable suspension composition is conducted in the presence of a release agent.

11. The process of claim 10, wherein the release agent is a low-molecular weight olefin polymer.

* * * * *